US006796811B1

(12) United States Patent
Pupkiewicz et al.

(10) Patent No.: US 6,796,811 B1
(45) Date of Patent: Sep. 28, 2004

(54) CONNECTOR WITH DEDICATED CONTACT REGIONS

(75) Inventors: Edward Joseph Pupkiewicz, Lansdale, PA (US); Bohdan Petro Wozniak, Warrington, PA (US); John Howard Seibert, Collegeville, PA (US); Joseph Anthony Kiszka, Freehold, NJ (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/631,659

(22) Filed: Jul. 31, 2003

(51) Int. Cl.[7] ..... H01R 4/58
(52) U.S. Cl. ..... 439/86; 439/591; 439/91; 439/66
(58) Field of Search ..... 439/492, 493, 439/496, 499, 86, 66, 591, 91; 29/825, 874, 830, 846, 878

(56) References Cited

U.S. PATENT DOCUMENTS 4,402,562 A * 9/1983 Sado ..... 439/91
4,449,774 A * 5/1984 Takashi et al. ..... 439/590
5,026,290 A * 6/1991 Dery ..... 439/65
5,273,439 A * 12/1993 Szerlip et al. ..... 439/66
5,277,593 A * 1/1994 Bates et al. ..... 439/66
5,360,347 A * 11/1994 Irlbeck et al. ..... 439/66
6,224,394 B1 * 5/2001 Matsumoto ..... 439/66
6,227,901 B1 5/2001 Pupkiewicz et al.
6,307,946 B1 10/2001 Fujimoto et al.
6,581,276 B2 * 6/2003 Chung ..... 29/825

* cited by examiner

*Primary Examiner*—True Nguyen
*Assistant Examiner*—Briggitte Hammond

(57) ABSTRACT

An electrical connector includes at least a first contact element and a second contact element, wherein each of the first and second contact elements include alternating conductive materials and nonconductive materials. An insulating layer separates the first contact element and the second contact element. The insulating layer divides the first and second contact elements into dedicated contact regions and has a length to prevent the first contact element and the second contact element from contacting more than one terminal contact surface on an electrical component.

20 Claims, 6 Drawing Sheets

CONNECTOR WITH DEDICATED CONTACT REGIONS

BACKGROUND OF THE INVENTION

This invention relates generally to electrical connectors, and more specifically, to layered connectors having dedicated contact elements for connecting closely spaced contact surfaces.

An increasing complexity of electronic assemblies in smaller packages are generating a need for new connectors to interconnect electronic components. For example, liquid crystal displays, vibratory motors, speakers and microphones are now being employed in devices of smaller and smaller size, such as cellular phone products and hand held devices. As the components become smaller and the terminals to connect the components are located closer together, known connectors are proving incapable of establishing reliable electrical connections.

The use of elastomeric connectors has become increasingly popular in some electronic devices because the connectors are readily adaptable in size and geometry to meet a large variety of applications. One type of elastomeric connector typically includes alternating layers of dielectric elastomer, such as silicon rubber, and an elastomer filled or doped with electrically conductive material such as silver particles, graphite particles, conductive fabrics, wires, etc. The dielectric elastomer layers are sandwiched between the conductive layers and are of sufficient thickness to insulate the conductive layers from one another and therefore prevent the formation of electrically conductive or leakage pathways between the conductive layers. The alternating dielectric and conductive layers provide a connector having a large number of conductive pathways in a small volume for closer contact spacing.

Components have now reached a size, however, where the contact spacing between contacts is reduced to a level that may cause shorting between the contacts through the conductive layers of the connector. For example, some microphone assemblies for cellular phones employ concentric positive and negative terminals in a disk-shaped arrangement. The positive terminal is located in the center portion of the disk and the negative terminal located in the surrounding portions of the disk with a small annular clearance extending between the positive and negative terminals. When a layered elastomeric connector is connected to the positive and negative terminals, some of the conductive layers may contact both the positive terminal and the negative terminal of the microphone assembly, therefore shorting the microphone terminals.

BRIEF DESCRIPTION OF THE INVENTION

In an exemplary embodiment of the invention, an electrical connector is provided. The connector comprises at least a first contact element and a second contact element, wherein each of the first and second contact elements includes alternating conductive materials and nonconductive materials. An insulating layer separates the first contact element and the second contact element.

Optionally, the insulating layer comprises a first end edge abutting the first contact element and a second end edge abutting the second contact element, and the first end edge and the second end edge extend substantially perpendicular to the alternating conductive layers and nonconductive layers. For example, the connector comprises a longitudinal axis, the insulating layer being oriented transverse to the longitudinal axis. Each contact element includes a top contact surface and a bottom contact surface, and the conductive and nonconductive materials extend between the top contact surface and the bottom contact surface. The insulation layer divides the first and second contact elements into dedicated contact regions and has a length to prevent the first contact element and the second contact element from contacting more than one terminal contact surface on an electrical component.

In another exemplary embodiment of the invention, an electronic assembly includes an electrical component having at least a first terminal contact surface and a second terminal contact surface separated by a gap. A connector comprising at least a first elastomeric element and a second elastomeric element, wherein each of the first and second elastomeric elements include alternating conductive layers and nonconductive layers. An insulating layer separates the first elastomeric element and the second elastomeric element, and the insulating layer spans the gap when the connector contacts the board to prevent shorting contact between the first terminal contact surface and the second terminal contact surface through the first elastomeric element and the second elastomeric element.

DETAILED DESCRIPTION OF THE INVENTION

Figure 1:
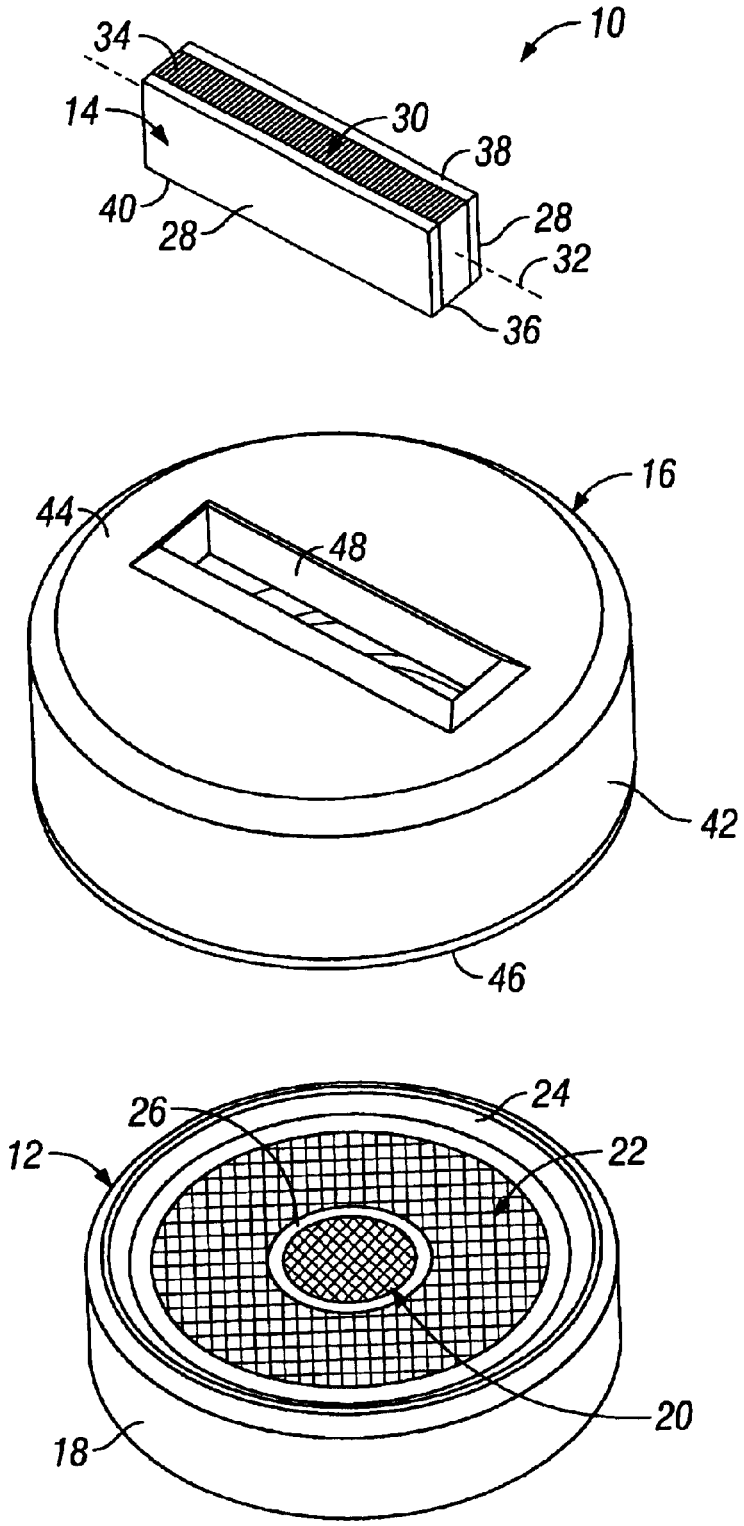
FIG. 1 (Prior Art)
FIG. 1 is an exploded perspective view of an electronic assembly including an elastomeric connector.
Figure 2:
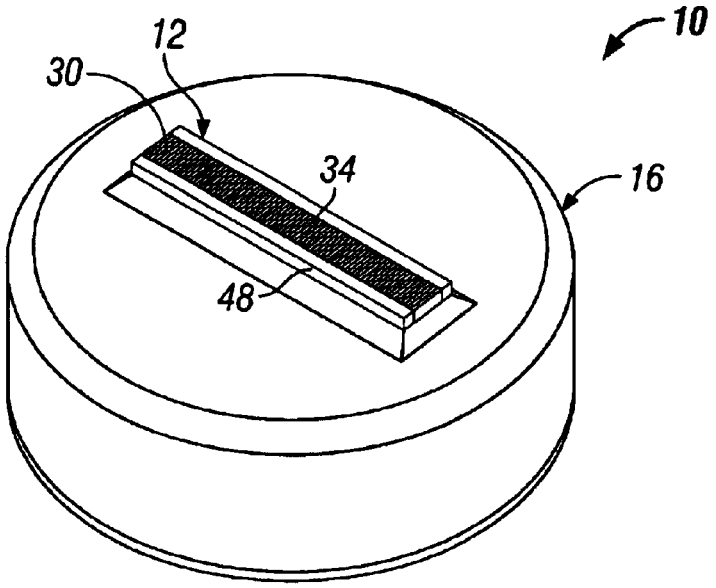
FIG. 2 (Prior Art)
FIG. 2 is a perspective view of the electronic assembly shown in FIG. 1 in an assembled condition.

FIG. 1 is an exploded perspective view and FIG. 2 is an assembled view of an electronic assembly 10 including an electrical component 12, a connector 14, and a boot 16 fitted over the electrical component 12 and receiving the connector 14. In an exemplary embodiment, the electrical component 12 is a miniature microphone assembly having a cylindrical housing 18 and concentric positive and negative terminal contact surfaces 20 and 22, respectively, extending within an inner circumference 24 of the housing 18. The positive terminal contact surface 20 is positioned in substantially a center of the housing 18 and the negative terminal contact surface 22 extends in an annular shape around the positive terminal contact surface 20. The positive and negative contact terminal surfaces 20 and 22 are generally coplanar within the housing and are separated by a nonconductive gap 26 in the form of a ring surrounding the positive terminal contact surface 20 and the negative terminal contact surface 22. The component 12 is of a small size for use in, for example, a cellular phone or other portable device.

The connector 14 is of a generally rectangular shape and includes a pair of outer insulation layers 28 with a conductive elastomeric element 30 therebetween. As explained below, the elastomeric element 30 includes alternative layers of a dielectric or insulating material, such as silicone rubber, and conductive layers, such as a known particle filled silicone elastomer. The conductive layers and the nonconductive layers extend substantially perpendicular to a longitudinal axis 32 of the connector 14, in a face-to-face relationship to one another in a continuous strip. The alternating nonconductive and conductive layers of the elastomeric element 30 provide a large number of conductive pathways through the elastomeric element 30 in a relatively small volume, and the non-conductive layers prevent current flow from one conductive layer to another within the elastomeric element 30.

The elastomeric element 30 includes opposed top and bottom surfaces 34 and 36 extending between the upper and lower edges 38 and 40, respectively, of the outer insulation layers 28. The bottom surface 36 contacts the positive and negative terminal contact surfaces 20 and 22 of the component 12, and the top surface 34 interfaces with, for example, a surface of a printed circuit board (not shown) associated with the component 12 in use. The conductive layers in the elastomeric element 30 therefore establish a plurality of conductive paths between each of the positive and negative terminal contact surfaces 20 and 22 of the component 12 and the printed circuit board through the connector 14.

The boot 16 includes a generally cylindrical body section 42, a top surface 44, and a bottom surface 46. The top surface 44 has a rectangular opening or cutout 48 therein which receives the connector 14. The bottom surface 46 of the boot 16 is open, and when the bottom surface 46 is fitted over the component 12, the component 12 is received within the body section 42 of the boot 16. In an exemplary embodiment, the boot 16 is fabricated from silicon rubber which protects the component 12 and the connector 14 from vibration in use. It is appreciated, however, that other known materials may be employed to fabricate the boot 16 in lieu of silicon rubber in alternative embodiments.

FIG. 2 illustrates the electronic assembly 10 in an assembled state. The connector 14 is received in the boot 16 and is in contact with the component 12 (shown in FIG. 1) inside the boot 16. The top surface 34 of the elastomeric element 30 in the connector 14 extends through the opening 48 in the boot 16. As such, the top surface 34 of the elastomeric element 30 is exposed for connection to, for example, a surface of a printed circuit board.

Figure 3:
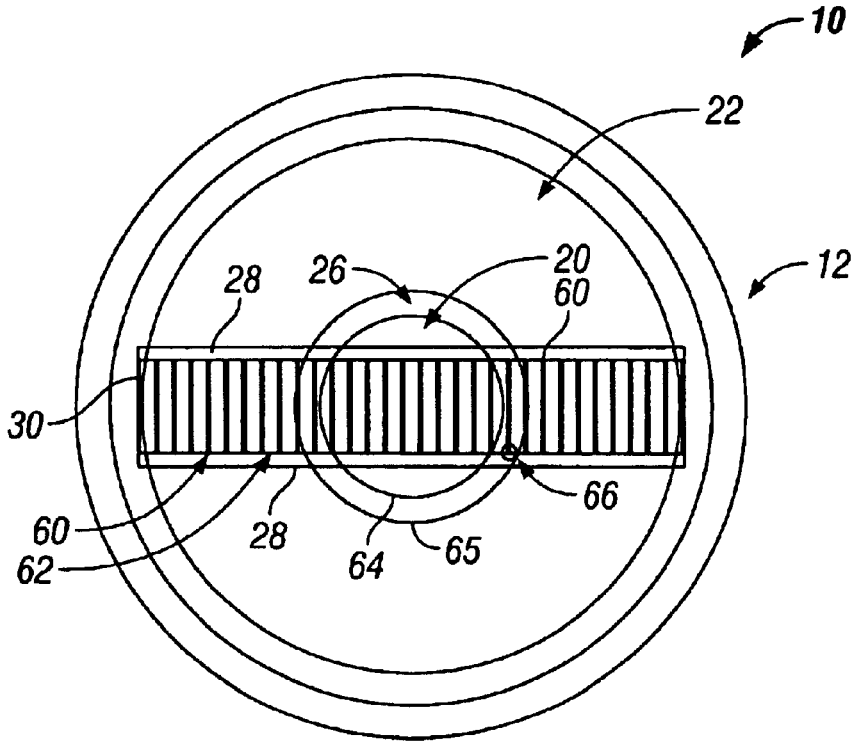
FIG. 3 (Prior Art)
FIG. 3 is a schematic top plan view of the electronic assembly shown in FIGS. 1 and 2.

FIG. 3 is a schematic top plan view of the electronic assembly 10 illustrating the connector 14 in contact with the component 12, and more specifically in contact with the positive and negative contact terminal surfaces 20 and 22 of the component 12. The elastomeric element 30 includes a number of conductive layers 60 and nonconductive layers 62 sandwiched together in an alternating pattern between the outer insulating layers 28 of the connector 14. Due to the close spacing between the contact terminal contact surfaces 20 and 22, it is seen that some of the conducting layers 60 located in the vicinity of the gap 26 may be shorted together through the conductive layers 60 of the elastomeric element 30. For example, in an area 66 of FIG. 3, one of the conducting layers 60 is positioned between the positive and negative terminal surfaces 20 and 22 in close proximity to both an outer perimeter 64 of the positive terminal contact surface 20 and an inner perimeter 65 of the negative terminal contact surface 22. This presents a possibility of the terminal contact surfaces 20 and 22 being shorted together through the conductive layer 60 in area 66. Shorting of the terminal contact surfaces 20 and 22 is a reliability issue in proper operation of the component.

Figure 4:
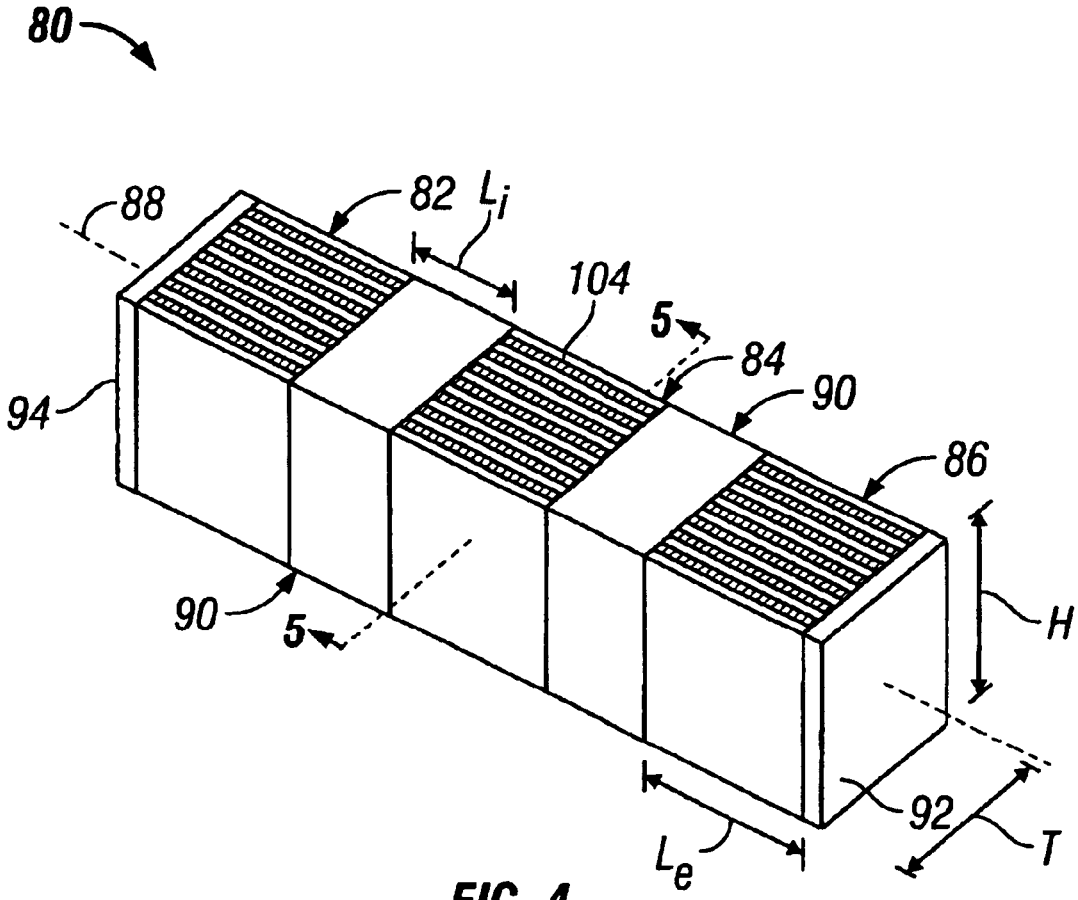
FIG. 4 is a perspective view of a connector formed in accordance with an embodiment of the present invention.

FIG. 4 is a perspective view of an electrical connector 80 formed in accordance with an embodiment of the present invention. The connector 80 includes a first contact element 82, a second contact element 84, and a third contact element 86. The contact elements 82, 84 and 86 are aligned with one another along a longitudinal axis 88 extending through the connector 80, and dielectric or insulation layers 90 separate the contact elements 82, 84, and 86 from one another along the longitudinal axis 88. That is, an insulation layer 90 extends between the first contact element 82 and the second contact element 84, and an insulation layer 90 extends between the second contact element 84 and the third contact element 86.

The connector 80 is substantially rectangular in an exemplary embodiment, although it is appreciated that other shapes of connectors may be formed without departing from the scope of the instant invention.

The contact elements 82, 84 and 86 are each substantially rectangular blocks having a length $L_e$, a thickness T and a height H, with the dimensions $L_e$, and T forming distinct contact surfaces, explained below, corresponding to the respective contact elements 82, 84 and 86. The insulation layers 90 are also substantially rectangular blocks having a length $L_i$, a thickness T and a height H substantially equal to the contact elements 82, 84, and 86. Optionally, insulating material 92 and 94 is provided on each of the opposite ends of the connector 80.

Figure 5:
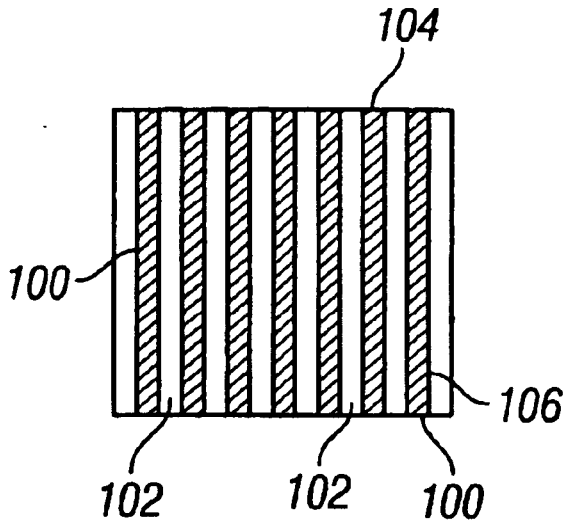
FIG. 5 is a cross sectional view of the connector shown in FIG. 4 along line 5—5.

FIG. 5 is a cross sectional view through one of the contact elements 84 including alternating conductive layers 100 and nonconductive layers 102 extending generally parallel to one another between a top contact surface 104 and a bottom contact surface 106. The conductive layers 100 and nonconductive layers 102 extend generally perpendicular to the top and bottom contact surfaces 104 and 106 and are oriented substantially parallel to the longitudinal axis 88. In an alternative embodiment, however, the conductive layers 100 and nonconductive layers 102 may extend transverse to the longitudinal axis 88, or at an angle with respect to the longitudinal axis 88.

The nonconductive layers 102 separate the conductive layers 100, thereby forming discrete current paths through the individual conductive layers 100 and 102 between the top and bottom contact surfaces 104 and 106. Thus, when the bottom contact surface 106 contacts a conductive surface, such as a terminal contact surface (not shown in FIG. 5) and the top contact surface 104 is coupled to another conductive surface (not shown in FIG. 5), current may flow through the conductive layers 100 between the respective conductive surfaces with the nonconductive layers 102 preventing current leakage between the conductive layers 100.

In an illustrative embodiment, the nonconductive layers 102 are fabricated from a known dielectric or insulating material, such as silicone rubber, and the conductive layers 100 are fabricated from a known particle filled silicone elastomer. The elastomeric elements may include any number of conductive layers 100 and nonconductive layers 102 as advisable for a given application. Additionally, each conductive layer 100 may include sublayers of conductive material, and each nonconductive layer 102 may include sublayers of nonconductive material. For example, one or both of the conductive and nonconductive layers 100 and 102 may include sheets or layers of material bonded together with known processes and techniques, including but not limited to lamination processes. The conductive layers and nonconductive layers 100 and 102 may be formed into the same or different thicknesses from one another in different embodiments.

In an alternative embodiment, the conductive layers may include, for example, wires or ribbons of conductive material in lieu of conductive silicon rubber, while nonetheless forming a layered or alternating construction of conductive and nonconductive materials in the dedicated contact regions 82, 84 and 86 of the connector 80.

In an exemplary embodiment, each of the contact elements 82 and 86 (shown in FIG. 4) are constructed similarly to contact element 84 (shown in FIG. 4). It is appreciated, however, that the contact elements 82, 84 and 86 need not be similarly constructed to one another in alternative embodiments of the invention. For example, the contact elements 82, 84 and 86 may have different numbers of conductive and/or nonconductive layers relative to one another and the relative dimensions of the layers in the elements 82, 84 and 86 need not be the same among the elements 82, 84 and 86.

Figure 6:
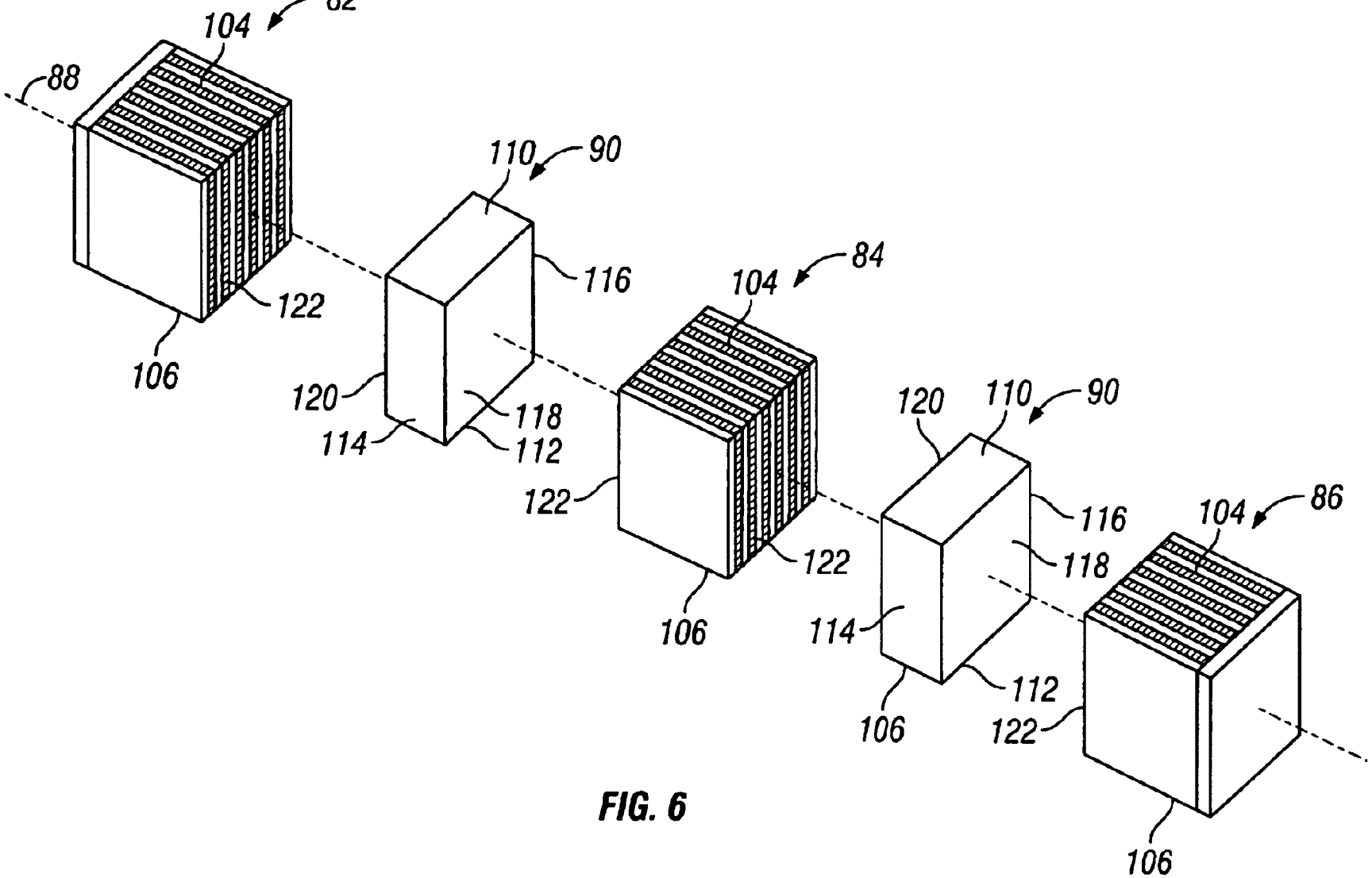
FIG. 6 is an exploded view of the connector shown in FIG. 4.

FIG. 6 is an exploded view of the connector 80 along the longitudinal axis 88. The insulating layers 90 are provided in the form of rectangular blocks aligned with the longitudinal axis 88 and positioned between the contact elements 82, 84 and 86. The layers 90 each include a top face or edge 110 positioned substantially flush with the top contact surfaces 104 of the contact elements 82, 84 and 86, and a bottom face or edge 112 positioned substantially flush with the bottom contact surfaces 106 of the contact elements 82, 84 and 86. Side edges 114 and 116 extend between the top and bottom edges 110 and 112, and end edges 118 and 120 extend between the top and bottom edges 110 and 112 in a transverse or substantially perpendicular orientation to the longitudinal axis 88.

The end edges 118 and 120 of the insulating layers 90 abut exposed end edges 122 of the contact elements 82, 84 and 86 and separate the elements 82, 84 and 86 from one another along the longitudinal axis 88. As such, the insulating layers 90 prevent current leakage between the contact elements 82, 84 and 86. The contact elements 82, 84, and 86 and insulating layers 90 may be coupled or otherwise bonded to one another with a known process or technique, such as a lamination process. Additionally, by including dedicated contact elements 82, 84, and 86 separated by the insulating layers 90, an amount of applied force to deflect the connector 80 is reduced by reducing the amount of conductive material in the connector 80.

Still further, the dedicated contact elements 82, 84, and 86 reduce shorting potential between adjacent contact surfaces in a plane parallel to the top and bottom edges 110 and 112 of the insulating layers 90 (i.e., a horizontal or x-axis plane) but also reduces shorting potential in a plane parallel to the end edges 118, 120 of the insulating layers 90 (i.e., a vertical or z-axis plane) extending between the top and bottom contact surfaces 104 and 106. As such, the connector 80 avoids shorting contact between contact surfaces in the same plane, such as in component 12, but also avoids shorting contact between mating substrates or components situated on either the top and bottom contact surfaces 104 and 106 of the connector 80.

Figure 7:
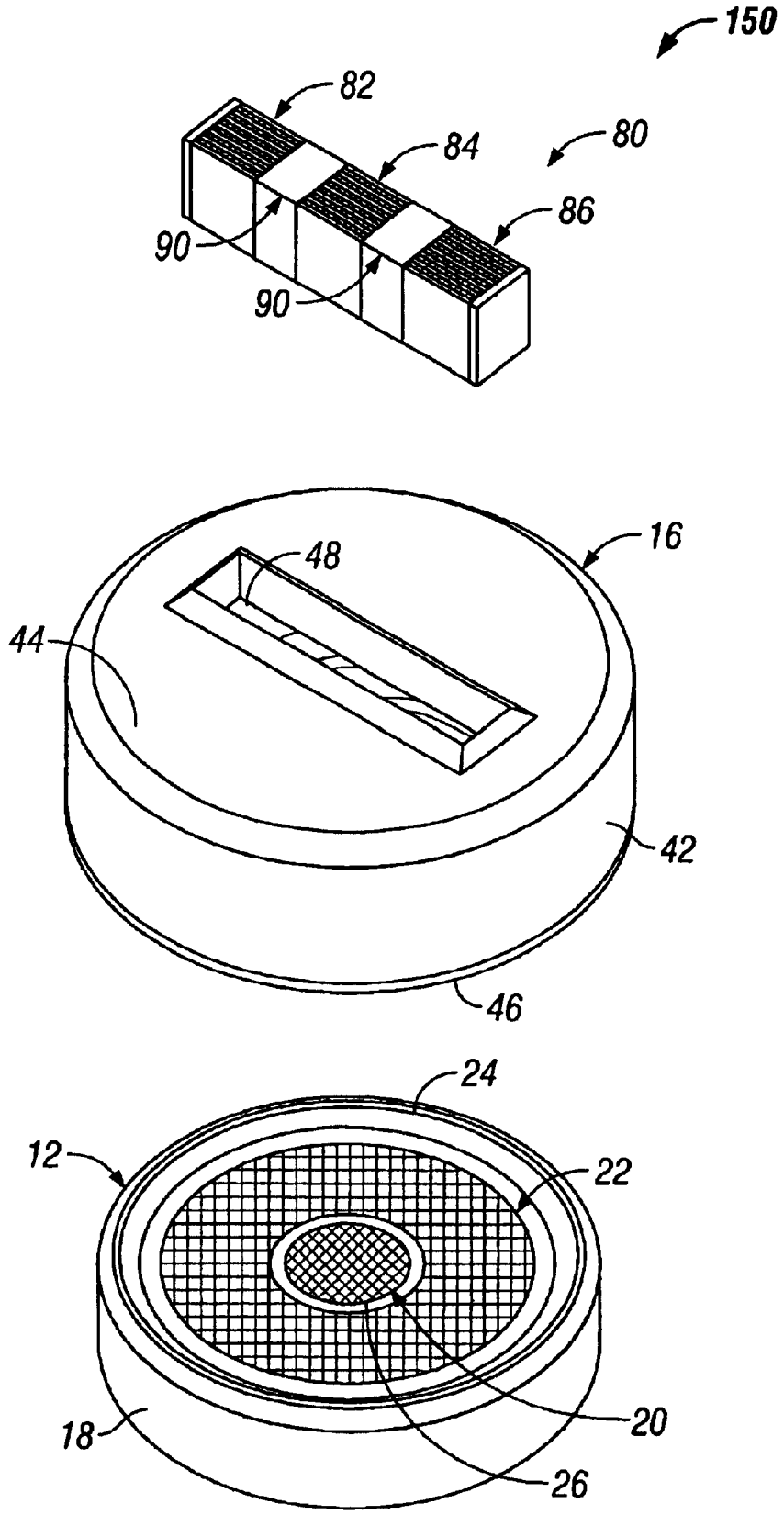
FIG. 7 is an exploded perspective view of an electronic assembly including the connector shown in FIG. 4.

FIG. 7 illustrates an exemplary electronic assembly 150 including the connector 80, an electrical component 12, and a boot 16 fitted over the electrical component 12 and receiving the connector 80.

In an exemplary embodiment, the electrical component 12 is a miniature microphone assembly having a cylindrical housing 18 and concentric positive and negative terminal contact surfaces 20 and 22, respectively, extending within an inner circumference 24 of the housing 18. The positive terminal contact surface 20 is positioned in substantially a center of the housing 18 and the negative terminal contact surface 22 extends in an annular shape around the positive terminal contact surface 20. The positive and negative contact terminal surfaces 20 and 22 are generally coplanar within the housing 18 and are separated by a nonconductive gap 26 in the form of a ring surrounding the positive terminal contact surface 20 and the negative terminal contact surface 22. The component 12 is of a small size for use in, for example, a cellular phone or other portable device. It is understood, however, that connector 80 could be used with other types of components 12, including but not limited to speaker assemblies and board-to-board assemblies having closely spaced contact surfaces. The invention shall not be limited to any particular use or application of the connector 80.

As will be seen below, and unlike the connector 14 (shown in FIG. 1), the conductive contact elements 82, 84, and 86 of the connector 80 establish distinct contact regions with the positive and negative contact terminal surfaces 20 and 22 while eliminating potential shorting between the contact terminal surfaces 20 and 22.

The boot 16 includes a generally cylindrical body section 42, a top surface 44, and a bottom surface 46. The top surface 44 has a rectangular opening or cutout 48 therein which receives the connector 80. The bottom surface 46 of the boot 16 is open, and when the bottom surface 46 is fitted over the component 12, the component 12 is received within the body section 42 of the boot 16. In an exemplary embodiment, the boot 16 is fabricated from silicon rubber which protects the component 12 and the connector 80 from vibration in use. It is appreciated, however, that other known materials may be employed to fabricate the boot 16 in lieu of silicon rubber in alternative embodiments. In still further alternative embodiments, it is appreciated that the connector 80 may be captured by a another component in lieu of the boot 16, and the component may be fabricated from plastic or other known materials suitable for maintaining the connector 80 in a desired position relative to the component 12.

It is further appreciated that the connector 80 may be unitarily constructed with the boot 16 or another component for ease of assembly of the electronic assembly 150. For example, the connector 80 may be insert molded into the boot 16 to produce a single piece construction, thereby eliminating insertion or assembly of the connector 80 into the boot 16 when the assembly 150 is produced.

Figure 8:
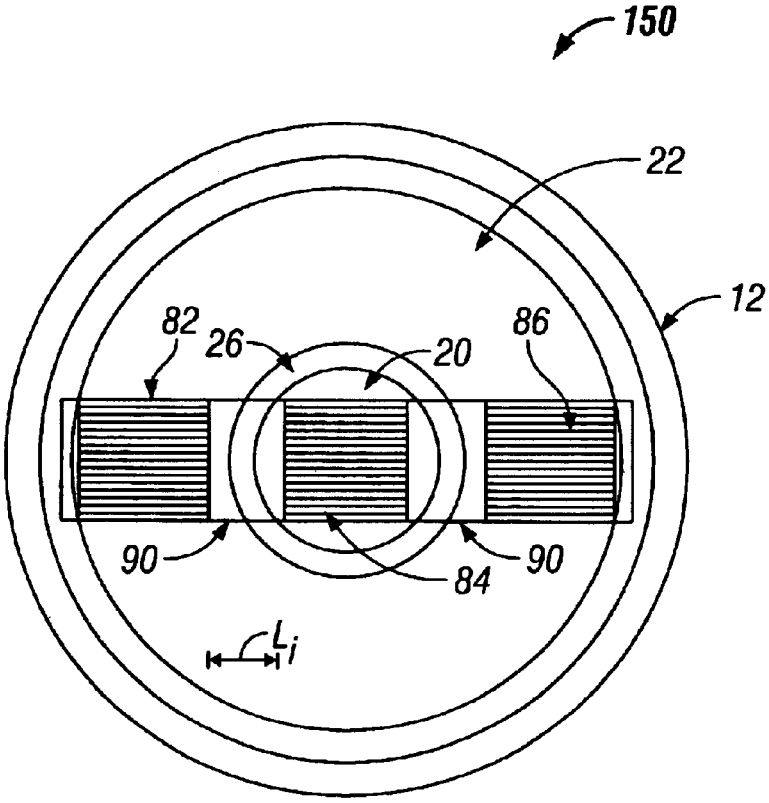
FIG. 8 is a schematic top plan view of the electronic assembly shown in FIG. 5.

FIG. 8 is a schematic top plan view of the electronic assembly 150 illustrating the connector 80 in contact with the component 12, and more specifically in contact with the positive and negative contact terminal surfaces 20 and 22 of the component 12. The dedicated contact elements 82 and 86 are positioned over the negative contact terminal surface 22, and the dedicated contact element 84 is positioned over the positive contact terminal surface 20. The insulating layers 90 of the connector 80 are located in the vicinity of the gap 26 separating the positive and negative contact terminal surfaces 20 and 22 on either side of the contact element 84. The insulating layers 90 have a length $L_i$ sufficient to prevent the contact elements 82, 84 and 86 from shorting the positive and negative contact terminal surfaces 20 and 22 together. In other words, length $L_i$ is sufficient to prevent any one of the contact elements 82, 84 and 86 from contacting more than one terminal contact surface 20 and 22 on the electrical component 12.

As such, the contact elements 82 and 86 form dedicated contact regions with the negative terminal contact surface 22 and the contact element 84 forms a dedicated contact region with the positive terminal contact surface 20. The insulating layers 90 separating the contact elements 82, 84 and 86 prevent shorting of the positive and negative contact terminal surfaces 20 and 22 in the vicinity of the gap 26.

Figure 9:
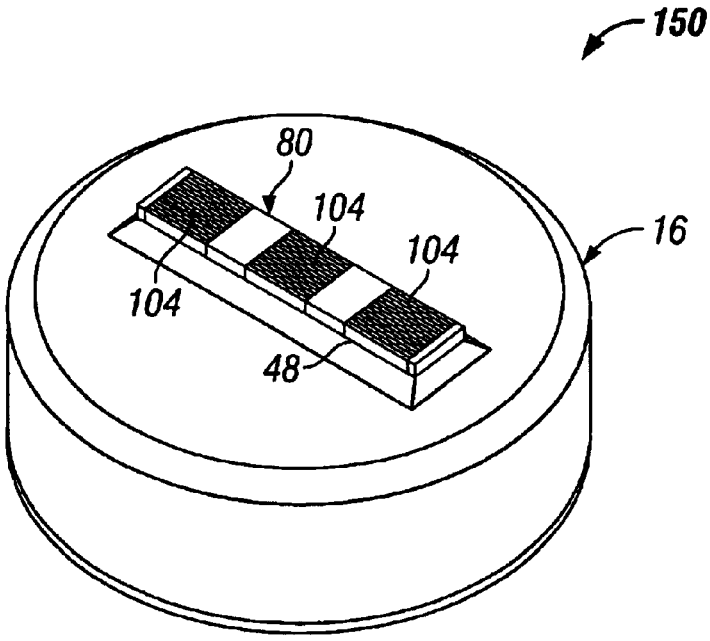
FIG. 9 is a schematic top plan view of the electronic assembly shown in FIG. 5 in an assembled condition.

FIG. 9 illustrates the electronic assembly 150 in an assembled state. The connector 80 is received in the boot 16 and is in contact with the component 12 (shown in FIG. 7) inside the boot 16. The top contact surfaces 104 of the contact elements 82, 84 and 86 extend through the opening 48 in the boot 16. As such, the top contact surfaces 104 of the contact elements 82, 84 and 86 are exposed for connection to, for example, a surface of a printed circuit board. As shorting of the contact terminal surfaces 20 and 22 of the component 12 (shown in FIGS. 7 and 8) is avoided, reliability of the electronic assembly 150 is increased relative to the electronic assembly 10 (shown in FIGS. 1–3).

While the invention has been described in terms of various specific embodiments, those skilled in the art will recognize that the invention can be practiced with modification within the spirit and scope of the claims.

What is claimed is:

1. An electrical connector for an electronic component having concentric positive and negative terminal contact surfaces, said electrical connector comprising:

at least a first contact element and a second contact element, each of said first and second contact elements including alternating conductive materials and nonconductive materials; and an insulating layer separating said first contact element and said second contact element by a predetermined distance;

wherein said first contact element establishes an electrical connection only with the positive terminal contact surface of the electronic component and the second contact element establishes an electrical connection only with the negative terminal contact surface, thereby preventing shorting contact between the positive and negative terminal contact surfaces of the electronic component when the connector is mounted to the electronic component.

2. An electrical connector in accordance with claim 1 wherein said insulating layer comprises a first end edge abutting said first contact element and a second end edge abutting said second contact element, said first end edge and said second end edge extending substantially perpendicular to said alternating conductive materials and nonconductive materials.

3. An electrical connector in accordance with claim 1 wherein said connector comprises a longitudinal axis, said insulating layer being oriented transverse to said longitudinal axis.

4. An electrical connector in accordance with claim 1 wherein each contact element includes a top contact surface and a bottom contact surface, said conductive and nonconductive materials extending between said top contact surface and said bottom contact surface, said insulating layer dividing said first and second contact elements into dedicated contact regions for the positive and negative terminal contact surfaces, respectively, of the electronic component.

5. An electrical connector in accordance with claim 1, said connector further comprising a third contact element including alternating conductive materials and nonconductive materials, and an insulating layer separating the conductive material of the first, second and third contact elements from one another along a longitudinal axis of the connector, wherein said second contact element establishes electrical contact with the positive terminal contact surface, and said first and third contact elements establish electrical contact with the negative terminal contact surface.

6. An electrical connector in accordance with claim 1, said first and second contact elements having a thickness, said insulating layer separating said first second contact elements having a thickness substantially equal to said thickness of said first and second contact elements.

7. An electrical connector in accordance with claim 1 wherein said first and second contact elements include respective end edges, said insulation layer being abutted to each of said end edges.

8. An electrical connector in accordance with claim 1 wherein the electronic component further includes an annular gap separating the positive and negative contact surfaces, said insulating layer having a length between said first and second contact elements to prevent said first contact element and said second contact element from component crossing the gap and shorting the positive and negative terminal contact surfaces.

9. An electrical connector in accordance with claim 1 wherein the electronic component further includes an annular gap separating the positive and negative contact surfaces, said first contact element being configured for dedicated contact with the positive terminal contact surface of the electrical component, said second contact element is configured for dedicated contact with the negative terminal contact surface of the electrical component, said insulating layer separating said first contact element and said second contact element and spanning the gap between the positive and negative terminal contact surfaces.

10. An electrical connector in accordance with claim 1 wherein at least one of said first contact element and said second contact element comprises an elastomeric element comprising alternating conductive and nonconductive layers.

11. An electronic assembly comprising:

an electrical component having at least a first terminal contact surface and a second terminal contact surface separated by a gap;

a connector comprising at least a first elastomeric element and a second elastomeric element, each of said first and second elastomeric elements including alternating conductive layers and nonconductive layers; and an insulating layer separating said first elastomeric element and said second elastomeric element, said insulating layer spanning said gap when said connector contacts said electrical component to prevent shorting contact between said first terminal contact surface and said second terminal contact surface through said first elastomeric element and said second elastomeric element.

12. An electronic assembly in accordance with claim 11 wherein said insulating layer comprises a first edge abutting said first elastomeric element and a second edge abutting said second elastomeric element, said first edge and said second edge extending substantially perpendicular to said alternating conductive layers and nonconductive layers.

13. An electronic assembly in accordance with claim 11 wherein said connector comprises a longitudinal axis, said insulating layer being oriented transverse to said longitudinal axis.

14. An electronic assembly in accordance with claim 11 wherein said connector includes a top contact surface and a bottom contact surface, said first and second elastomeric elements extending between said top contact surface and said bottom contact surface, said insulation layer dividing said first and second contact surfaces into dedicated contact regions.

15. An electronic assembly in accordance with claim 11, said connector further comprising a third elastomeric element including alternating conductive layers and nonconductive layers, and an insulation layer separating the conductive layers of the first, second and third elastomeric elements from one another along a longitudinal axis of the connector.

16. An electronic assembly in accordance with claim 11, said first and second elastomeric elements having a thickness, said insulating layer separating said first conductive element and said second conductive element having a thickness substantially equal to said thickness of said first and second elastomeric elements.

17. An electronic assembly in accordance with claim 11 wherein said first and second elastomeric elements include end edges, said insulation layer being abutted to each of said end edges.

18. An electronic assembly in accordance with claim 11, said insulating layer having a length to prevent said first elastomeric element and said second elastomeric from contacting more than one of first terminal contact surface and said second terminal contact surface.

19. An electronic assembly in accordance with claim 11 wherein said first elastomeric element is configured for dedicated contact with said first terminal contact surface, said second elastomeric element is configured for dedicated contact with said second terminal contact surface, said insulating layer spanning said gap.

20. An electronic assembly in accordance with claim 11 wherein said first terminal contact surface is concentric with said second terminal contact surface, said connector further comprising a third elastomeric element including alternating conductive layers and nonconductive layers, said first and third elastomeric elements contacting said first terminal contact surface and said second elastomeric element contacting said second terminal contact surface when said connector is coupled to said component.

* * * * *